US009548039B2

(12) United States Patent
Arasawa et al.

(10) Patent No.: US 9,548,039 B2
(45) **Date of Patent: *Jan. 17, 2017**

(54) DISPLAY DEVICE

(71) Applicant: Semiconductor Energy Laboratory Co., Ltd., Atsugi-shi, Kanagawa-ken (JP)

(72) Inventors: Ryo Arasawa, Kanagawa (JP); Hiroyuki Miyake, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/170,671

(22) Filed: Feb. 3, 2014

(65) Prior Publication Data

US 2014/0146034 A1 May 29, 2014

Related U.S. Application Data

(62) Division of application No. 11/964,564, filed on Dec. 26, 2007, now Pat. No. 8,643,635.

(30) Foreign Application Priority Data

Dec. 27, 2006 (JP) ..... 2006-353029

(51) Int. Cl.
*G09G 5/00* (2006.01)
*G09G 3/20* (2006.01)
*G09G 3/32* (2016.01)

(52) U.S. Cl.
CPC *G09G 5/00* (2013.01); *G09G 3/20* (2013.01); *G09G 3/3258* (2013.01);
(Continued)

(58) Field of Classification Search
CPC ..... G09G 3/20; G09G 3/3258; G09G 5/00; G09G 2300/0857; G09G 2330/021; G09G 2330/028
(Continued)

(56) References Cited

U.S. PATENT DOCUMENTS 5,712,652 A 1/1998 Sato
5,798,746 A 8/1998 Koyama
(Continued)

FOREIGN PATENT DOCUMENTS

CN 1874551 A 12/2006
GB 2292866 A 3/1996
(Continued)

OTHER PUBLICATIONS

European Search Report (European Patent Application No. 07025137.6) dated Feb. 25, 2010.
(Continued)

*Primary Examiner* — Jimmy H Nguyen
(74) *Attorney, Agent, or Firm* — Fish & Richardson P.C.

(57) ABSTRACT

A display device is driven through no wire cable such as an FPC, and a display image is continuously held for a certain period of time by storing an image signal received from a wireless communication device so that the display image can be held even when the display device is out of communication range with the wireless communication device. A display device includes at least a pixel circuit having an SRAM (static random access memory) circuit, a circuit which controls the pixel circuit, an antenna circuit, a circuit which generates a demodulation signal, a circuit which rectifies a wireless signal, a circuit which generates first voltage, a charge circuit which stores second voltage, a charge control circuit, a voltage supply control circuit, and
(Continued)

a circuit which controls the charge control circuit and the voltage supply control circuit.

18 Claims, 10 Drawing Sheets

(52) U.S. Cl.
CPC ..... *G09G 2300/0857* (2013.01); *G09G 2330/021* (2013.01); *G09G 2330/028* (2013.01)

(58) Field of Classification Search
USPC ..... 345/76–104, 204, 211, 212
See application file for complete search history.

(56) References Cited

U.S. PATENT DOCUMENTS

| | | | | |
|---|---|---|---|---|
| 5,945,972 | A | 8/1999 | Okumura | |
| 6,765,549 | B1 | 7/2004 | Yamazaki | |
| 6,774,876 | B2 | 8/2004 | Inukai | |
| 6,900,460 | B2 | 5/2005 | Yamazaki | |
| 6,952,298 | B2 | 10/2005 | Hara | |
| 7,282,380 | B2 | 10/2007 | Maruyama | |
| 7,757,958 | B2 | 7/2010 | Ito | |
| 2003/0098875 | A1 | 5/2003 | Kurokawa | |
| 2003/0141504 | A1 | 7/2003 | Kuwabara | |
| 2003/0141590 | A1* | 7/2003 | Kamiya et al. | 257/730 |
| 2003/0226041 | A1 | 12/2003 | Palmer | |
| 2004/0133787 | A1 | 7/2004 | Doughty | |
| 2004/0145454 | A1 | 7/2004 | Powell | |
| 2005/0134463 | A1 | 6/2005 | Yamazaki | |
| 2005/0246621 | A1 | 11/2005 | Ogawa | |
| 2005/0254183 | A1 | 11/2005 | Ishida | |
| 2006/0017659 | A1 | 1/2006 | Ogawa | |
| 2006/0209060 | A1 | 9/2006 | Tanada | |
| 2006/0267769 | A1 | 11/2006 | Ito | |
| 2007/0163010 | A1 | 7/2007 | Ishii | |
| 2007/0229279 | A1 | 10/2007 | Yamazaki | |

FOREIGN PATENT DOCUMENTS

| | | | |
|---|---|---|---|
| JP | 07-057067 | A | 3/1995 |
| JP | 10-307898 | A | 11/1998 |
| JP | 11-345292 | A | 12/1999 |
| JP | 2000-115038 | A | 4/2000 |
| JP | 2000-123135 | A | 4/2000 |
| JP | 2002-057617 | A | 2/2002 |
| JP | 2003-070187 | A | 3/2003 |
| JP | 2003-259570 | A | 9/2003 |
| JP | 2004-062161 | A | 2/2004 |
| JP | 2005-094862 | A | 4/2005 |
| JP | 2005-148453 | A | 6/2005 |
| JP | 2005-156618 | A | 6/2005 |
| JP | 2005-202947 | A | 7/2005 |
| JP | 2005-316672 | A | 11/2005 |
| JP | 2005-321911 | A | 11/2005 |
| JP | 2005-354888 | A | 12/2005 |
| JP | 2006-004015 | A | 1/2006 |
| JP | 2006-018132 | A | 1/2006 |
| JP | 2006-503376 | T | 1/2006 |
| JP | 2006-127363 | A | 5/2006 |
| JP | 2006-172121 | A | 6/2006 |
| WO | WO 2004/036482 | A1 | 4/2004 |

OTHER PUBLICATIONS

Office Action, Chinese Application No. 200710160852.7, dated Jul. 8, 2011, 12 pages with English translation.

* cited by examiner

DISPLAY DEVICE

CROSS-REFERENCE TO RELATED APPLICATIONS

This application is a divisional of U.S. application Ser. No. 11/964,564, filed Dec. 26, 2007, now allowed, which claims the benefit of a foreign priority application filed in Japan as Serial No. 2006-353029 on Dec. 27, 2006, both of which are incorporated by reference.

BACKGROUND OF THE INVENTION

1. Field of the Invention

The present invention relates to a display device which holds a display image for a certain period of time even when the display device is out of communication range of wireless communication.

2. Description of the Related Art

In recent years, an individual identification technique using wireless communication with an electromagnetic field, an electric wave, or the like has attracted attention. In particular, an individual identification technique using an RFID (radio frequency identification) tag as a semiconductor device which updates data by wireless communication has attracted attention. An RFID tag (hereinafter, simply referred to as an RFID) is also called an IC (integrated circuit) tag, an IC chip, an RF tag, a wireless tag, or an electronic tag. The individual identification technique using an RFID has come to help production, management, or the like of an individual object, and is studied to be applied to individual authentication.

There is a passive type RFID which can transmit an electric wave or an electromagnetic wave each including information and which is driven by utilizing electric power of an electric wave or an electromagnetic wave (carrier wave) from an external portion (see Patent Document 1: Japanese Published Patent Application No. 2006-503376). In the passive type RFID, a power source for driving an RFID is generated by utilizing electric power of an electric wave or an electromagnetic wave (carrier wave) from an external portion, and thus, a structure without a battery is realized.

Meanwhile, a display device is actively developed as a large-sized display device such as a liquid crystal television becomes common. Further, as an application of a passive type RFID, a display device which directly transmits an image signal by wireless communication has also attracted attention (see Patent Document 2: Japanese Published Patent Application No. 2006-018132). It is needed that a display device is within a distance that can communicate with a wireless communication device. Therefore, electric power cannot be received when communication range with the wireless communication device is not suitable. Accordingly, there is a limitation that the display device is always within a communicable distance.

As for the RFID tag, the longer the distance through which an electric wave or an electromagnetic wave (carrier wave) transmitted from a wireless communication device is received, the more a supplied electric wave is attenuated and electric power which can be generated is reduced. Further, when the RFID tag is out of communication range, an electric wave itself is not supplied and electric power cannot be generated.

Further, there is a case where a communication distance between the RFID tag and the wireless communication device is desired to be long depending on a use. Therefore, a problem on receiving power in the case of long-distance communication cannot be ignored.

Meanwhile, operation of the display device can be controlled through an FPC or the like, using a driver circuit, a controller IC, and so on, which are formed of transistors. Thus, the degree of freedom is limited due to the shape of a wire cable such as an FPC.

The display device receives an image signal and generates electric power by wireless communication, and accordingly, it is necessary to be always within a communicable distance to hold a display image. When the display device is moved out of communication range with the wireless communication device, supply of electric power is stopped, and the display image is off.

SUMMARY OF THE INVENTION

An object of the present invention is to drive a display device through no wire cable such as an FPC, and to continuous hold a display image for a certain period of time by storing an image signal received from a wireless communication device so that the display image can be held even when the display device is out of communication range with the wireless communication device.

One aspect of a display device of the present invention is a display device including at least a pixel circuit having an SRAM (static random access memory) circuit, a circuit which controls the pixel circuit, an antenna circuit, a circuit which generates a demodulation signal, a circuit which rectifies a wireless signal, a circuit which generates first voltage, a charge circuit which stores second voltage, a charge control circuit, a voltage supply control circuit, and a circuit which controls the charge control circuit and the voltage supply control circuit.

Another aspect of a display device of the present invention is a display device including a display portion, a pixel circuit included in the display portion, a circuit which controls the pixel circuit, an antenna circuit, a circuit which generates a demodulation signal from a wireless signal received by the antenna circuit, a circuit which rectifies the wireless signal received by the antenna circuit, a circuit which generates first voltage from voltage rectified in the circuit which rectifies the wireless signal received by the antenna circuit, a charge circuit which stores second voltage from voltage rectified in the circuit which rectifies the wireless signal received by the antenna circuit, a charge control circuit which performs charging of the second voltage to the charge circuit, a voltage supply control circuit, a circuit which controls the charge control circuit and the voltage supply control circuit, and a circuit which selects the first voltage or the second voltage, where the pixel circuit includes an SRAM circuit as a storage capacitor, and the voltage supply control circuit supplies the second voltage to the circuit which selects the first voltage or the second voltage.

With the above-described structure, at least one of the objects can be solved.

The pixel circuit is provided with an SRAM circuit, a selecting TFT, a driving TFT, a scanning line, a signal line, a power supply line, a ground line (also referred to as a GND line), an SRAM power supply line, a display element, and a counter electrode. A gate electrode of a first TFT of the SRAM circuit, a drain electrode of a second TFT, and a gate electrode of the driving TFT are electrically connected to one electrode of the selecting TFT. The signal line is electrically connected to the other electrode of the selecting TFT. The display element is electrically connected to one electrode of the driving TFT, and the power supply line is electrically connected to the other electrode of the driving TFT. The SRAM power supply line is connected to a source electrode of the first TFT of the SRAM circuit, and the ground line is connected to a source electrode of the second TFT of the SRAM circuit, and an image signal of the signal line is stored in the SRAM circuit.

The circuit which rectifies the wireless signal received by the antenna circuit is electrically connected to both the circuit which generates first voltage and the circuit which controls the charge control circuit and the voltage supply control circuit. With such a circuit structure, the display device can be reduced in size.

The circuit which generates the demodulation signal from the wireless signal received by the antenna circuit includes a first demodulation circuit and a second demodulation circuit, and the demodulation signal generated in the first demodulation circuit is supplied to the circuit which controls the pixel circuit, and the demodulation signal generated in the second demodulation circuit is supplied to the charge control circuit. With such a circuit structure, by only providing one antenna circuit in the display device, signals can be generated from the received wireless signal: a signal which controls the circuit which controls the pixel circuit, and a signal which controls the charge control circuit, the voltage supply control circuit, the circuit which controls the charge control circuit and the voltage supply control circuit, and the circuit which selects the first voltage or the second voltage.

Another aspect of the present invention is that voltage selected in the circuit which selects the first voltage or the second voltage is supplied to the circuit which controls the pixel circuit.

A storage capacitor provided in the circuit which selects the first voltage or the second voltage compensates voltage supply in a period in which voltage is not supplied to the circuit which controls the pixel circuit, which occurs when voltage selected in the circuit which selects the first voltage or the second voltage is supplied to the circuit which controls the pixel circuit. By providing the storage capacitor in the circuit which selects the first voltage or the second voltage, driving of the circuit which controls the pixel circuit can be prevented from being stopped.

Another aspect of the present invention is that the circuit which controls the charge control circuit and the voltage supply control circuit includes a voltage comparison circuit, monitors voltage of the charge circuit, and compares it with predetermined voltage which is based on ground voltage, so that voltage supply to the circuit which controls the pixel circuit is stopped during charging of the charge circuit or that charging is stopped during voltage supply to the circuit which controls the pixel circuit. With the circuit which controls the charge control circuit and the voltage supply control circuit, the charge circuit can be prevented from being overcharged.

Another aspect of the present invention is that the circuit which controls the charge control circuit and the voltage supply control circuit includes a counter circuit, and after a certain period of time passes from starting of voltage supply to the circuit which controls the pixel circuit, the circuit which controls the charge control circuit and the voltage supply control circuit stops voltage supply to the circuit which controls the pixel circuit. With the circuit which controls the charge control circuit and the voltage supply control circuit, excessive voltage supply to the circuit which controls the pixel circuit can be avoided, and low power consumption can be realized.

Further, a display device may be provided with a plurality of antennas. One aspect of the display device of the present invention is a display device provided with a display portion, a pixel circuit included in the display portion, a circuit which controls the pixel circuit, a first antenna circuit, a second antenna circuit, a circuit which generates a demodulation signal from a wireless signal received by the first antenna circuit, a circuit which rectifies the wireless signal received by the first antenna circuit, a circuit which generates a demodulation signal from the wireless signal received by the second antenna circuit, a circuit which rectifies the wireless signal received by the second antenna circuit, a circuit which generates first voltage from voltage rectified in the circuit which rectifies the wireless signal received by the first antenna circuit, a charge circuit which stores second voltage from voltage generated in the circuit which rectifies the wireless signal received by the second antenna circuit, a charge control circuit which performs charging of the second voltage to the charge circuit, a voltage supply control circuit, a circuit which controls the charge control circuit and the voltage supply control circuit, and a circuit which selects the first voltage or the second voltage, where the pixel circuit includes an SRAM circuit as a storage capacitor, and the voltage supply control circuit supplies the second voltage to the circuit which selects the first voltage or the second voltage.

With the above-described structure, at least one of the objects can be solved.

In the above-described structure, another aspect of the present invention is that the second antenna circuit has a different shape from the first antenna circuit, and the second antenna circuit charges the charge circuit with the use of the wireless signal which is received from the second antenna circuit, independently from the first antenna circuit. By providing a plurality of antenna circuits, the charge circuit can be charged even when a wireless signal is not received by the first antenna circuit.

In the above-described structure, voltage generated from the circuit which rectifies the wireless signal received by the first antenna circuit is supplied to the circuit which generates the first voltage, while voltage generated from the circuit which rectifies the wireless signal received by the second antenna circuit is supplied to the circuit which controls the charge control circuit and the voltage supply control circuit.

In the present invention, by providing the SRAM circuit in the display device, the image signal received from a wireless communication device can be stored. That is, when the image signal is received once, a display image corresponding to the image signal can be held until electric power which is generated by an electric wave transmitted from the wireless communication device is exhausted.

In the present invention, by providing a wireless charge circuit in a display device, a wireless signal can be received from a wireless communication device and the wireless charge circuit can be charged. Further, when charging voltage reaches predetermined voltage, the wireless charge circuit serves as a power supply by voltage supply to the display device, and the display device can be driven. At this time, it is not necessary to continuously communicate between the display device and the wireless communication device.

In the present invention, by providing the SRAM circuit and the wireless charge circuit, the image signal received from the wireless communication device is stored in the SRAM circuit, and at the same time, the wireless charge circuit is charged. Further, the charged wireless charge circuit serves as a power supply by voltage supply to the display device, and the display device can be driven. When the display device is driven, it is not necessary to continuously communicate between the display device and the wireless communication device. If charging is performed once, even when the display device is out of communication range with the wireless communication device, the display device can be independently driven for a certain period of time by using the image signal stored in the SRAM circuit and voltage supply from the wireless charge circuit.

In the present invention, the circuit which controls the charge control circuit and the voltage supply control circuit is provided to prevent overcharging, so that the charge control circuit is controlled to stop charging in the case where voltage stored in the charge circuit is equal to or greater than predetermined voltage.

In the present invention, by providing a counter circuit in the circuit which controls the charge control circuit and the voltage supply control circuit, after voltage stored in the wireless charge circuit is supplied for a certain period of time, voltage supply can be automatically stopped, and accordingly, excessive voltage supply can be suppressed, and low power consumption can be realized.

In the present invention, by providing the antenna circuits with different shapes, different wireless signals can be received, and only charging can be performed even when the display device is not driven.

DETAILED DESCRIPTION OF THE INVENTION

Figure 1:
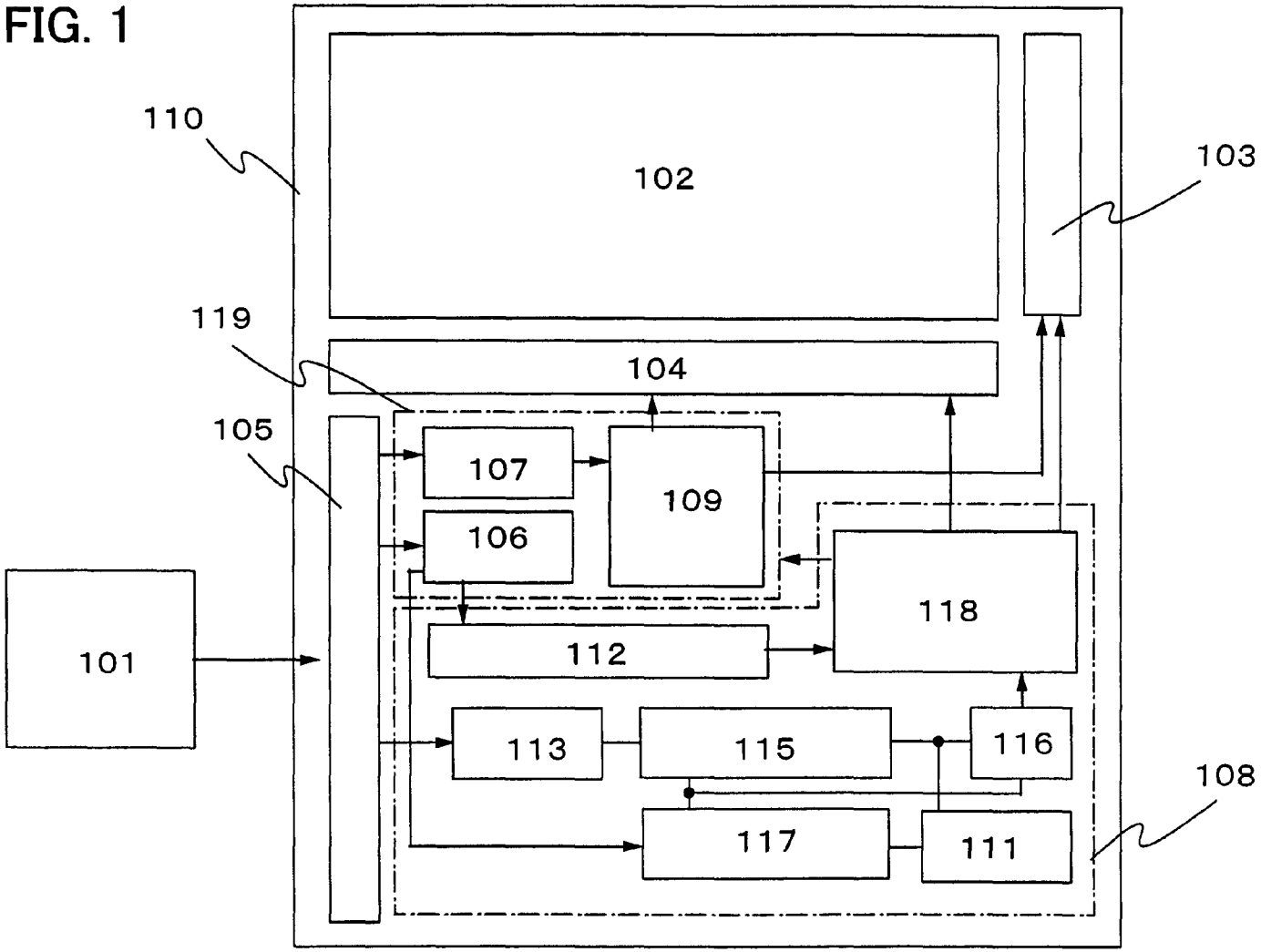
FIG. 1 is a view showing a structural example of a display device of Embodiment Mode 1.

Embodiment modes and an embodiment of the present invention will be explained below with reference to the accompanied drawings. However, the present invention can be implemented in various different modes, and it is to be easily understood that various changes and modifications in modes and details thereof will be apparent to those skilled in the art without departing from the purpose and the scope of the present invention. Therefore, the present invention should not be interpreted as being limited to the description of the embodiment modes and the embodiment to be given below.

As a frequency of a carrier wave transmitted and received between an antenna and a reader/writer, 125 kHz, 13.56 MHz, 915 MHz, 2.45 GHz, and the like are given, each of which is standardized by the ISO standard or the like. It is needless to say that a frequency of the carrier wave transmitted and received between the antenna and the reader/writer is not limited to them, and any of the following may be adopted: a submillimeter wave of 300 GHz to 3 THz; a millimeter wave of 30 GHz to 300 GHz; a microwave of 3 GHz to 30 GHz; an ultrahigh frequency wave of 300 MHz to 3 GHz; a very high frequency wave of 30 MHz to 300 MHz; a short wave of 3 MHz to 30 MHz; a medium wave of 300 kHz to 3 MHz; a long wave of 30 kHz to 300 kHz; and a very low frequency wave of 3 kHz to 30 kHz.

A carrier wave may be modulated by either analog modulation or digital modulation, and any of amplitude modulation, phase modulation, frequency modulation, and spread spectrum modulation may be adopted. Preferably, amplitude modulation or frequency modulation is adopted.

It is to be noted that there are no particular limitation, on the shape of the antenna that can be used for the present invention. For this reason, as a transmission method, an electromagnetic coupling method, an electromagnetic induction method, an electric wave method, an optical method, or the like can be used. The implementer should select the transmission method, as appropriate, in consideration of the intended use, and an antenna with the most appropriate length and shape for the transmission method selected should be provided. An electric wave method can be used for the signal transmission method in the present invention, and further, a microwave method can be used, as well. In the case of employing an electromagnetic coupling method or an electromagnetic induction method (e.g., 13.56 MHz band) as the transmission method, electromagnetic induction by change of the electric field density is utilized; therefore, a conductive film serving as an antenna is formed into a circular shape (such as a loop antenna) or a spiral shape (e.g., a spiral antenna). In the case of employing a microwave method (e.g., a UHF band (860 to 960 MHz band), a 2.45 GHz band, or the like), which is one kind of an electric wave method, as the transmission method, a length or a shape of the conductive film serving as an antenna may be appropriately set in consideration of a wavelength of an electric wave used for signal transmission. The conductive film serving as an antenna can be formed in, for example, a linear shape (e.g., a dipole antenna), a flat shape (e.g., a patch antenna), and the like. The shape of the conductive film serving as an antenna is not limited to a linear shape, and the conductive film serving as an antenna may be formed in a curved-line shape, a meander shape, or a combination thereof, in consideration of the wavelength of the electromagnetic wave.

Further, in this specification, a source and a drain of the TFT are names adopted for convenience to distinguish electrodes except a gate in a structure of the TFT. In the present invention, in a case of a structure where a polarity of the TFT is not limited, names of a source and a drain change when the polarity is considered. Therefore, a source or a drain may be described as one of one electrode and the other electrode.

(Embodiment Mode 1)

FIG. 1 shows a structural example of this embodiment mode.

This embodiment mode includes a reader/writer 101, which is a wireless communication device, and a display device 110.

The display device 110 includes a display portion 102, a scanning line control circuit 103, a signal line control circuit 104, an antenna circuit 105, a signal processing circuit 119, and a power generation portion 108.

The signal processing circuit 119 includes a demodulation circuit 107, a rectifier circuit 106, and a control portion 109. The power generation portion 108 includes a constant voltage circuit 112, a demodulation circuit 113, a charge control circuit 115, a voltage supply control circuit 116, a circuit 117 which controls the charge control circuit and the voltage supply control circuit, a charge circuit 111, and a voltage selection circuit 118. The voltage selection circuit 118 is provided with a storage capacitor. Further, by sharing the rectifier circuit 106, reduction in size of a display device can be accomplished.

A modulated carrier wave (hereinafter, also referred to as a wireless signal) transmitted from the reader/writer 101 is received by the antenna circuit 105. In general, a wireless communication signal is transmitted by performing processing, such as amplitude modulation and/or phase modulation, to a carrier with a frequency of 13.56 MHz, 915 MHz, or the like. For example, in the case where the wireless communication signal of 13.56 MHz is used, it is desirable that a frequency of an electromagnetic wave from the reader/writer 101, which is for charging the charge circuit 111, be the same as that of the wireless communication signal. The signal for charging and the signal for communication are set to be in the same frequency band; thus, the antenna circuit 105 can be shared. By sharing the antenna circuit 105, reduction in size of the display device 110 can be accomplished.

Voltage is generated from a wireless signal received by the antenna circuit 105, through the rectifier circuit 106 and the constant voltage circuit 112. The generated voltage is supplied to the voltage selection circuit 118.

Voltage selected in the voltage selection circuit 118 is supplied to circuits provided in the signal processing circuit 119, the scanning line control circuit 103, and the signal line control circuit 104.

A wireless signal, which is received by the antenna circuit 105 and is modulated, is demodulated by the demodulation circuit 107 and then supplied to the control portion 109.

Control signals (a clock, a start pulse, an image signal, and so on) are generated in the control portion 109. The generated control signals are supplied to the scanning line control circuit 103 and the signal line control circuit 104. Thus, a desired image is displayed on the display portion 102.

Meanwhile, a wireless signal transmitted from the reader/writer 101 is also supplied to the charge circuit 111 through the rectifier circuit 106 and the demodulation circuit 113. In the case where charging voltage of the charge circuit 111 exceeds predetermined voltage, the charging voltage is supplied to the voltage selection circuit 118 from the voltage supply control circuit 116 controlled by the circuit 117 which controls the charge control circuit and the voltage supply control circuit.

The voltage selection circuit 118 selects either voltage supplied from the constant voltage circuit 112 or voltage supplied from the voltage supply control circuit 116 in the case where communication is performed or not performed between the reader/writer 101 and the display device 110; the case where the reader/writer 101 and the display device 110 are out of communication range and charging voltage of the charge circuit 111 exceeds predetermined voltage; the case where charging voltage of the charge circuit 111 does not exceed predetermined voltage; or the like.

In the case where voltage is supplied from either the constant voltage circuit 112 or the voltage supply control circuit 116, supplied voltage is selected as it is.

At the moment when the voltage selection circuit 118 selects voltage, a period occurs during which voltage is not supplied to the circuits provided in the signal processing circuit 119, the scanning line control circuit 103, and the signal line control circuit 104 from the voltage selection circuit 118. In this period, voltage for driving of the display portion 102 is compensated with voltage stored in the storage capacitor of the display portion 102.

It is preferable that the voltage selection circuit 118 selects voltage supplied from the constant voltage circuit 112 first to control the display portion 102.

It is preferable that the voltage selection circuit 118 selects voltage supplied from the voltage supply control circuit 116 when the display portion 102 has been controlled and an image signal has been stored in an SRAM circuit. In this case, voltage supplied from the constant voltage circuit 112 is used to control the display portion 102. Therefore, voltage supplied from the voltage supply control circuit 116 can be used only for storing the image signal by the SRAM circuit, and accordingly, a display image can be held for a long time.

When a counter circuit is provided in the circuit 117 which controls the charge control circuit and the voltage supply control circuit, voltage supply can be automatically stopped after supplying voltage for a certain period of time. Accordingly, excessive electric power can be prevented and low power consumption can be realized.

(Embodiment Mode 2)

Figure 2:
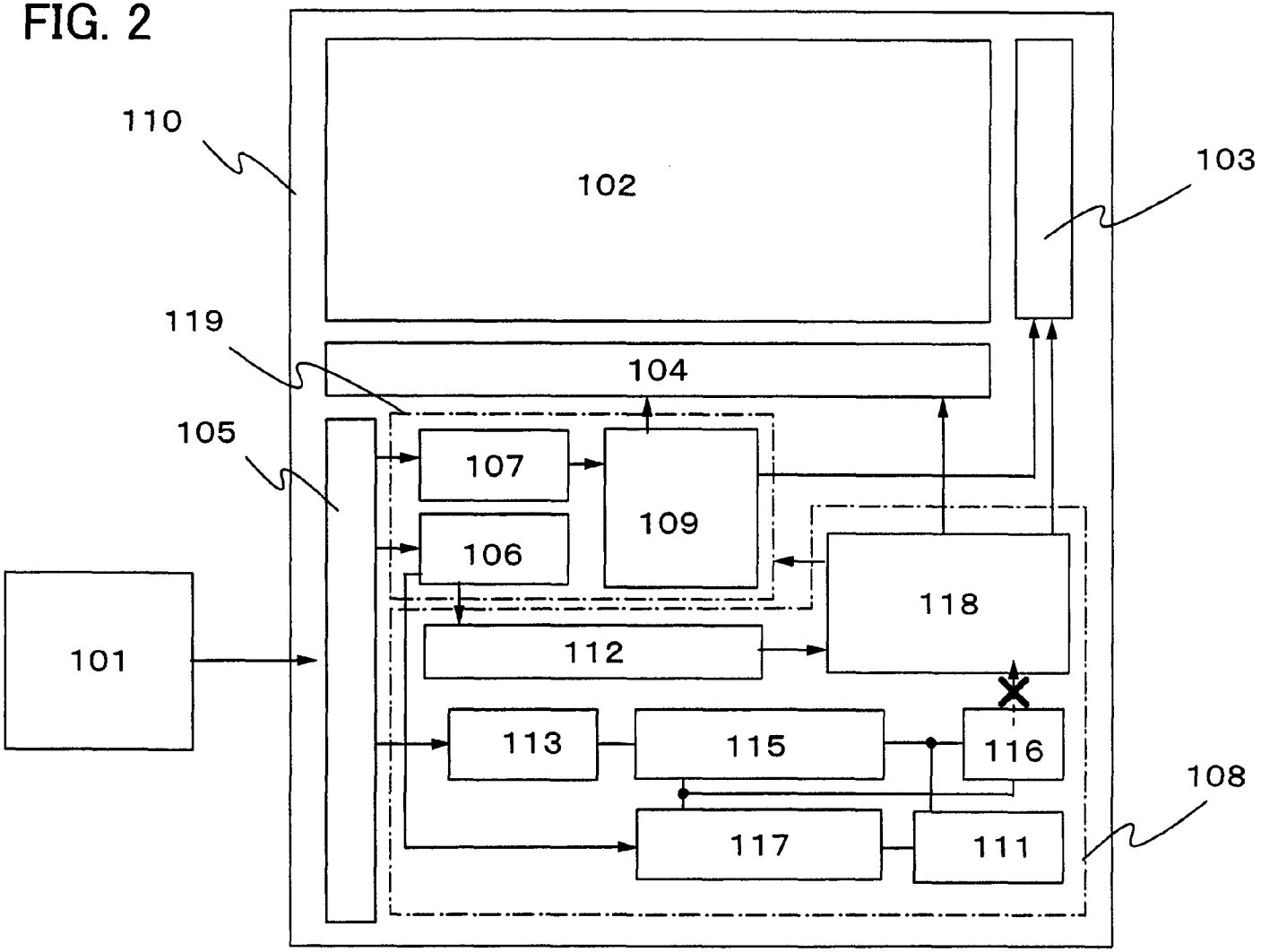
FIG. 2 is a view showing a structural example of a display device of Embodiment Mode 2.

FIG. 2 shows an embodiment mode of the case where the display portion 102 is controlled using voltage supplied from the constant voltage circuit 112. It is to be noted that a dotted arrow with a cross in the drawing means that voltage is not supplied from the voltage supply control circuit 116 to the voltage selection circuit 118.

A modulated carrier wave (hereinafter, also referred to as a wireless signal) transmitted from the reader/writer 101 is received by the antenna circuit 105. Voltage is generated from the wireless signal received by the antenna circuit 105, through the rectifier circuit 106 and the constant voltage circuit 112. The generated voltage is supplied to the voltage selection circuit 118.

Meanwhile, the wireless signal transmitted from the reader/writer 101 is also supplied to the charge circuit 111 through the rectifier circuit 106 and the demodulation circuit 113. In the case where charging voltage of the charge circuit 111 exceeds predetermined voltage, the voltage supply control circuit 116 is controlled by the circuit 117 which controls the charge control circuit and the voltage supply control circuit so that the charging voltage is not supplied to the voltage selection circuit 118.

The voltage selection circuit 118 supplies voltage, which is supplied from the constant voltage circuit 112, to the circuits provided in the signal processing circuit 119, the scanning line control circuit 103, and the signal line control circuit 104.

Control signals are generated in the control portion 109 provided in the signal processing circuit 119. The generated control signals are supplied to the scanning line control circuit 103 and the signal line control circuit 104. Thus, a desired image is displayed on the display portion 102.

This embodiment mode can be freely combined with Embodiment Mode 1.

(Embodiment Mode 3)

Figure 3:
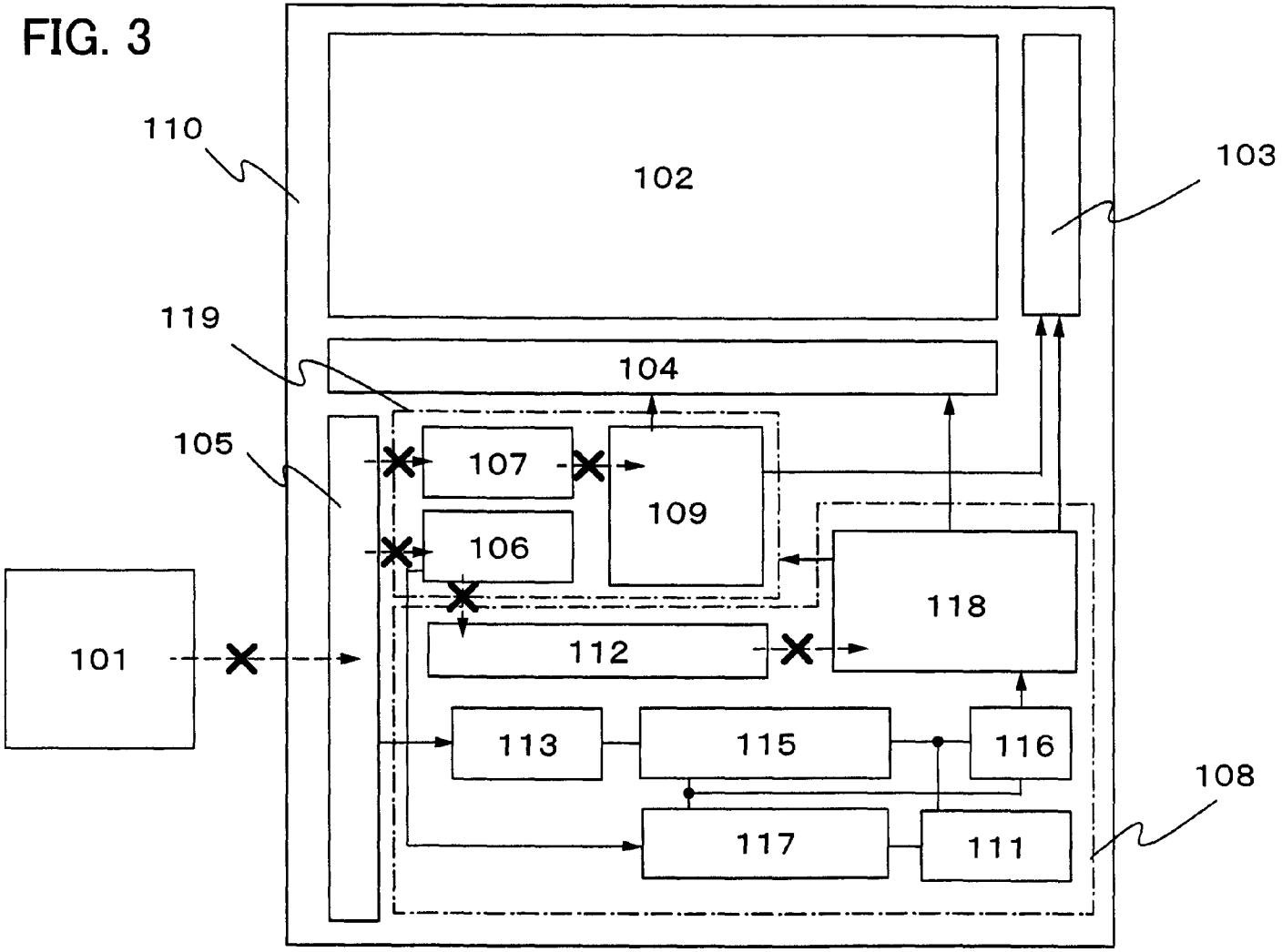
FIG. 3 is a view showing a structural example of a display device of Embodiment Mode 3.

FIG. 3 shows an embodiment mode of the case where display on the display portion 102 is held using voltage supplied from the charge circuit 111.

It is to be noted that FIG. 3 shows a case where transmission of an electromagnetic wave from the reader/writer 101 is stopped after charging of the charge circuit 111 is completed or that the reader/writer 101 and the display device 110 are out of wireless communication range. Further, a dotted arrow with a cross in the display device 110 in the drawing means that electric power and voltage are not generated.

A modulated carrier wave (hereinafter, also referred to as a wireless signal) transmitted from the reader/writer 101 is received by the antenna circuit 105. Voltage is generated from a wireless signal received by the antenna circuit 105, through the rectifier circuit 106 and the constant voltage circuit 112. The generated voltage is supplied to the voltage selection circuit 118.

Voltage selected by the voltage selection circuit 118 is supplied to the circuits provided in the signal processing circuit 119, the scanning line control circuit 103, and the signal line control circuit 104. A wireless signal, which is received by the antenna circuit 105 and modulated, is demodulated by the demodulation circuit 107 and then supplied to the control portion 109.

Control signals (a clock, a start pulse, an image signal, and so on) are generated in the control portion 109. The generated control signals are supplied to the scanning line control circuit 103 and the signal line control circuit 104. Thus, a desired image is displayed on the display portion 102.

Meanwhile, a wireless signal transmitted from the reader/writer 101 is also supplied to the charge circuit 111 through the rectifier circuit 106 and the demodulation circuit 113. In the case where charging voltage of the charge circuit 111 exceeds predetermined voltage, the charging voltage is supplied to the voltage selection circuit 118 from the voltage supply control circuit 116 controlled by the circuit 117 which controls the charge control circuit and the voltage supply control circuit.

At the moment when the voltage selection circuit 118 selects voltage, a period occurs during which voltage is not supplied to the circuits provided in the signal processing circuit 119, the scanning line control circuit 103, and the signal line control circuit 104. However, in this period, voltage for driving of the display portion 102 is compensated with voltage stored in the storage capacitor of the display portion 102.

By providing a counter circuit in the circuit 117 which controls the charge control circuit and the voltage supply control circuit, voltage supply can be automatically stopped after supplying voltage for a certain period of time. Accordingly, excessive electric power can be prevented, and low power consumption can be realized.

This embodiment mode can be freely combined with Embodiment Mode 1 or Embodiment Mode 2. The display device is controlled by the circuit 117 which controls the charge control circuit and the voltage supply control circuit, whereby driving described in Embodiment Mode 1, Embodiment Mode 2, or Embodiment Mode 3 is performed.

(Embodiment Mode 4)

Figure 4:
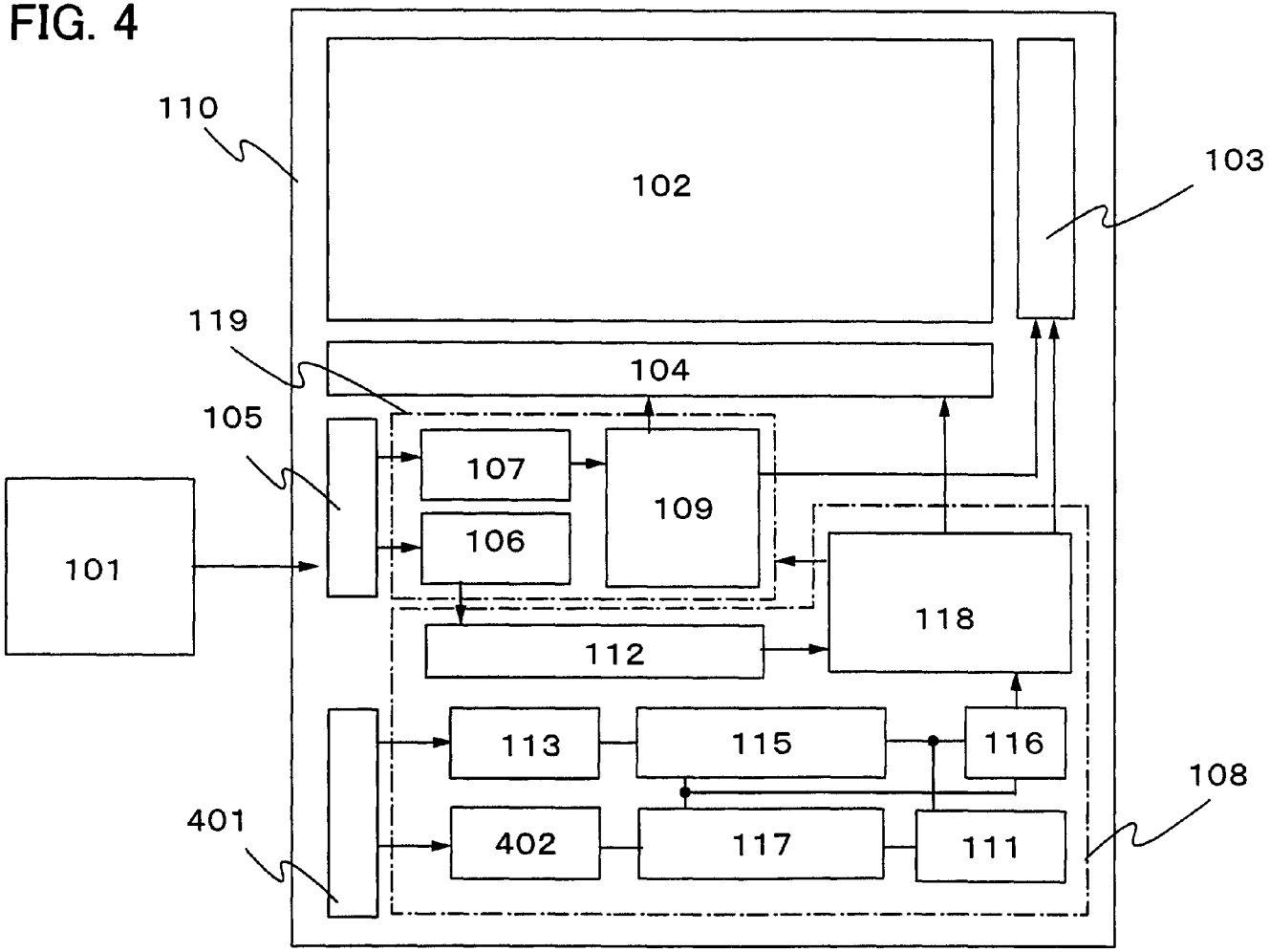
FIG. 4 is a view showing a structural example of a display device of Embodiment Mode 4.

FIG. 4 shows an embodiment mode of the case where a first antenna circuit 105 and a second antenna circuit 401 are included.

The case is described where the second antenna circuit 401 receives an electromagnetic wave which is randomly generated outside, and the first antenna circuit 105 receives an electromagnetic wave with a specific wavelength, which is transmitted from the reader/writer 101. In order to receive an electromagnetic wave different from that received by the first antenna circuit 105, the second antenna circuit 401 desirably has a shape different from that of the first antenna circuit 105.

The second antenna circuit 401 receives a weak electromagnetic wave which is randomly generated outside, and the charge circuit 111 is charged little by little over a certain period of time through a rectifier circuit 402. The circuit 117 which controls the charge control circuit and the voltage supply control circuit monitors the state of charging of the charge circuit 111, and on/off of switches provided in the charge control circuit 115 and the voltage supply control circuit 116 is controlled, whereby the charge circuit 111 is prevented from being overcharged. Further, here, a structure is given in which voltage stored in the charge circuit 111 is supplied to the voltage selection circuit 118.

The first antenna circuit 105 receives an electromagnetic wave with a specific wavelength, which is transmitted from the reader/writer 101. Furthermore, the rectifier circuit 106 is provided in the signal processing circuit 119, and the constant voltage circuit 112 is provided in the power generation portion 108, whereby voltage for driving the control portion 109 can be secured.

As described above, when the charge circuit 111 which can be wirelessly charged is provided, a wireless charge circuit provided in the display device 110 can be easily charged. Further, the charge circuit 111 is charged by receiving an electromagnetic wave over a certain period of time, and stored voltage is supplied. Accordingly, even when a weak electromagnetic wave is used for charging the charge circuit 111, high voltage can be supplied from the charge circuit 111. In particular, in the case where the charge circuit 111 is charged by receiving a weak electromagnetic wave, which is randomly generated outside, by the second antenna circuit 401, the display device 110 described in this embodiment mode is highly effective.

(Embodiment Mode 5)

Figure 5A:
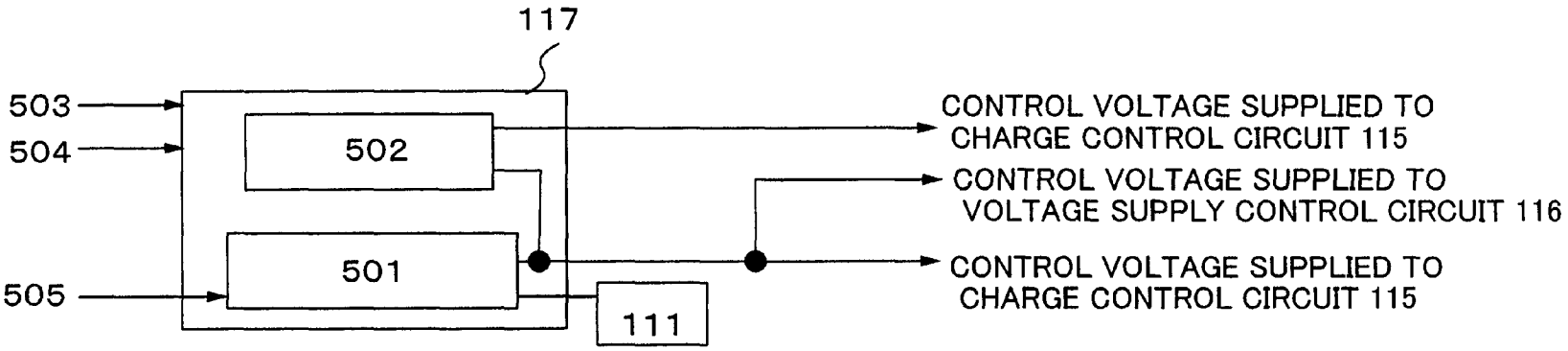
FIGS. 5A and 5B are views showing structural examples of a voltage control circuit and a voltage selection circuit, respectively, of Embodiment Modes 5 and 6.

FIG. 5A shows a structural example of a circuit 117 which controls the charge control circuit and the voltage supply control circuit.

A demodulation signal 503 and rectified voltage 504 are input to the circuit 117 which controls the charge control circuit and the voltage supply control circuit. A voltage comparison circuit 501 is provided, in which reference voltage 505 is supplied to one input and voltage of a charge circuit 111 is supplied to the other input.

Control voltage is supplied from the voltage comparison circuit 501 to the charge control circuit 115 and the voltage supply control circuit 116 so that the charge control circuit 115 is controlled until the charging voltage reaches reference voltage and that the voltage supply control circuit 116 is controlled after the charging voltage reaches the reference voltage.

In addition, a counter circuit 502 is provided in the circuit 117 which controls the charge control circuit and the voltage supply control circuit, so that control voltage supplied to the charge control circuit 115 and the voltage supply control circuit 116 is supplied. The counter circuit 502 supplies control voltage to the voltage supply control circuit 116 after counting a certain number. Voltage supply to the voltage supply control circuit 116 is stopped with the use of control voltage supplied from the counter circuit 502.

(Embodiment Mode 6)

Figure 5B:
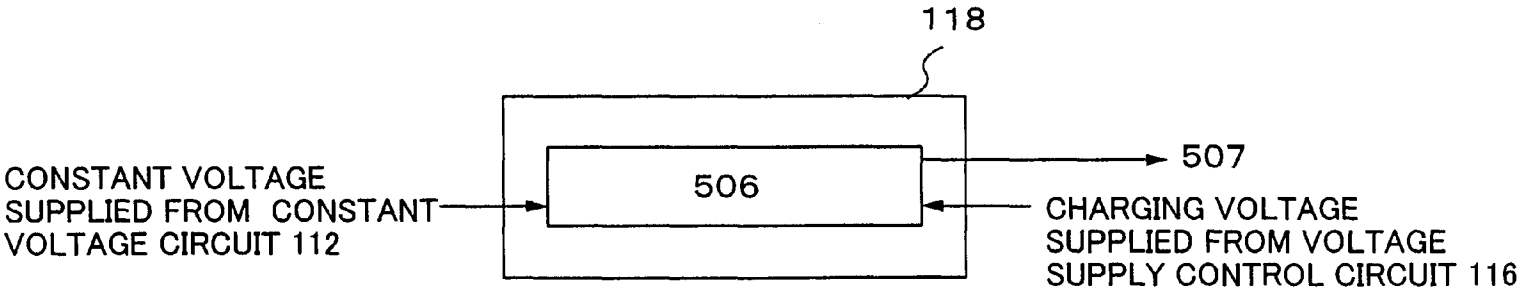

FIG. 5B shows a structural example of a voltage selection circuit 118.

The voltage selection circuit 118 is provided with a voltage level comparison circuit 506 for comparing voltage supplied from the constant voltage circuit 112 and the voltage supply control circuit 116. Constant voltage supplied from the constant voltage circuit 112 is supplied to one input of the voltage level comparison circuit 506, and charging voltage supplied from the voltage supply control circuit 116 is supplied to the other input thereof.

The constant voltage and the charging voltage which are input are compared with each other by the voltage level comparison circuit 506, and as a result of the comparison, voltage which is higher than the other is supplied, as selected voltage 507, to the circuits provided in the signal processing circuit 119, the scanning line control circuit 103, and the signal line control circuit 104.

A switch or the like is provided so that ground voltage (also referred to as GND voltage) is input to the voltage level comparison circuit 506 when voltage is not supplied from the constant voltage circuit 112 and the voltage supply control circuit 116. Accordingly, in the case where voltage is supplied only from one of the constant voltage circuit 112 and the voltage supply control circuit 116 to the voltage selection circuit 118, the levels of the supplied voltage and the GND voltage are compared with each other; thus, the supplied voltage can be the selected voltage 507 as it is.

(Embodiment Mode 7)

Figure 6:
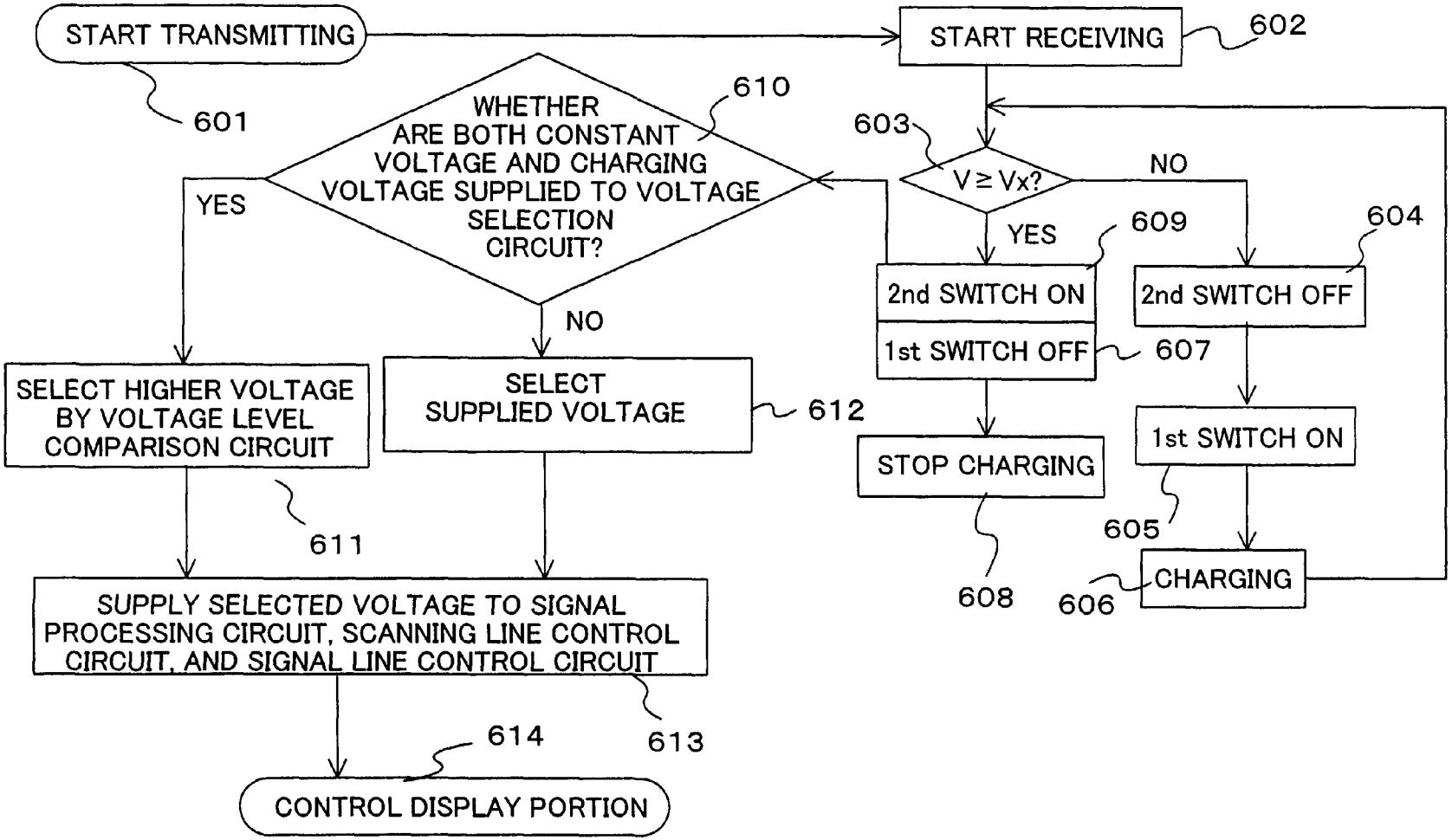
FIG. 6 is a flowchart of Embodiment Mode 7.

FIG. 6 shows an example of the case where the antenna circuit 105 receives an electromagnetic wave from the reader/writer 101, operation of charging of the charge circuit 111 is performed, and the display portion 102 is controlled. In addition, here, an example is shown where a first switch is provided for the charge control circuit 115 and a second switch is provided for the voltage supply control circuit 116. The display portion 102 is controlled using voltage supplied from the constant voltage circuit 112 over a period until charging of the charge circuit 111 is completed.

First, when an electromagnetic wave is transmitted from the reader/writer 101 (601), the antenna circuit 105 starts receiving the electromagnetic wave transmitted from the reader/writer 101 (602). Next, the circuit 117 which controls the charge control circuit and the voltage supply control circuit checks, using the voltage comparison circuit or the like, whether voltage of the charging circuit 111 is greater than or equal to, or less than predetermined voltage (for example, Vx) which is based on ground voltage (603). In the case where voltage of the charge circuit 111 is lower than Vx, the second switch provided for the voltage supply control circuit 116 is turned off (604) so that electric power of the charge circuit 111 is not supplied to other circuits.

Next, the first switch is turned on (605), and charging of the charge circuit 111 is started (606). During the charging, the state of charging of the charge circuit 111 is monitored by the circuit 117 which controls the charge control circuit and the voltage supply control circuit, and a voltage value of the charge circuit 111 is monitored. When voltage of the charge circuit 111 is equal to or greater than predetermined voltage, the first switch provided for the charge control circuit 115 is turned off (607), so that the charging is stopped (608).

Next, at the same time when the first switch is turned off, the second switch is turned on (609), and voltage is supplied to the voltage selection circuit 118 through the voltage supply control circuit 116.

The voltage selection circuit 118 determines whether voltages are supplied from the constant voltage circuit 112 and the voltage supply control circuit 116 to the voltage selection circuit 118 (610). Immediately after that, voltage selection is performed.

In the case where voltages are supplied from the constant voltage circuit 112 and the voltage supply control circuit 116 to the voltage selection circuit 118, the levels of supplied voltages are compared with each other in the voltage level comparison circuit, and voltage higher than the other is selected (611). In the case where charging voltage exceeds predetermined voltage, since voltage supplied from the constant voltage circuit 112 is constant voltage, charging voltage is selected in most cases. However, in the case where charging voltage is lower than constant voltage, the relation therebetween is reversed, and constant voltage is selected.

In the case where voltage is supplied only from one of the constant voltage circuit 112 and the voltage supply control circuit 116 to the voltage selection circuit 118, the supplied voltage is selected as it is (612).

Voltage selected in the voltage selection circuit 118 is supplied to the circuits provided in the signal processing circuit 119, the scanning line control circuit 103, and the signal line control circuit 104 (613).

Control signals or the like are generated in the control portion 109 provided in the signal processing circuit 119 to which voltage is supplied, the scanning line control circuit 103, and the signal line control circuit 104, thereby controlling the display portion 102 (614).

Figure 7:
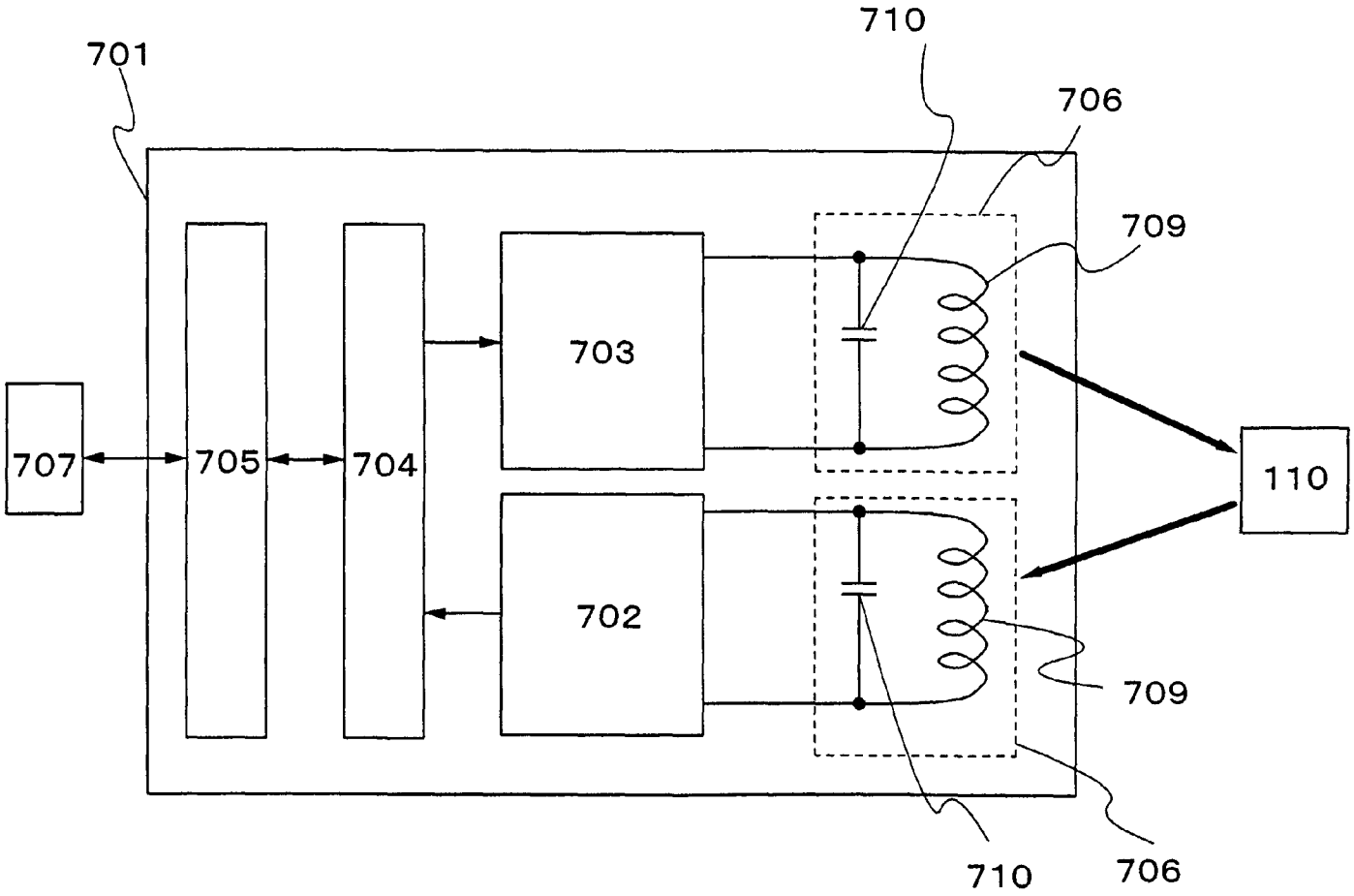
FIG. 7 is a view showing a structural example of a reader/writer.

FIG. 7 shows a structural example of a reader/writer.

A reader/writer 701 includes a receiving portion 702, a transmitting portion 703, a controlling portion 704, an interface portion 705, and antenna circuits 706. The controlling portion 704 controls the receiving portion 702 and the transmitting portion 703 for data processing order and a data processing result, under control by a reader/writer controlling device 707 through the interface portion 705. The transmitting portion 703 modulates data processing order to be transmitted to the display device 110, and the modulated data processing order is output as an electromagnetic wave from the antenna circuit 706. The receiving portion 702 demodulates a signal received by the antenna circuit 706, and the signal is output, as a data processing result, to the control portion 704.

In this embodiment mode, the antenna circuits 706 of the reader/writer 701 shown in FIG. 7 are connected to the receiving portion 702 and the transmitting portion 703, and each have an antenna 709 and a resonant capacitor 710 which form an LC parallel resonant circuit. The antenna circuit 706 receives, as an electric signal, electromotive force which is induced to the antenna circuit 706 by a signal output from the display device 110. While, an induced current is supplied to the antenna circuit 706 and a signal is transmitted from the antenna circuit 706 to the display device 110.

(Embodiment Mode 8)

A plurality of pixels, each of which is provided with a display element and a pixel circuit electrically connected to the display element, is provided in matrix in a display portion. The pixel circuit is a circuit including a TFT and the like, and in this embodiment mode, the pixel circuit is provided with an SRAM circuit.

It is to be noted that, in the present invention, a specific example is described in this embodiment mode, using an EL element as the display element. However, the display element is not limited to an EL element.

Figure 8:
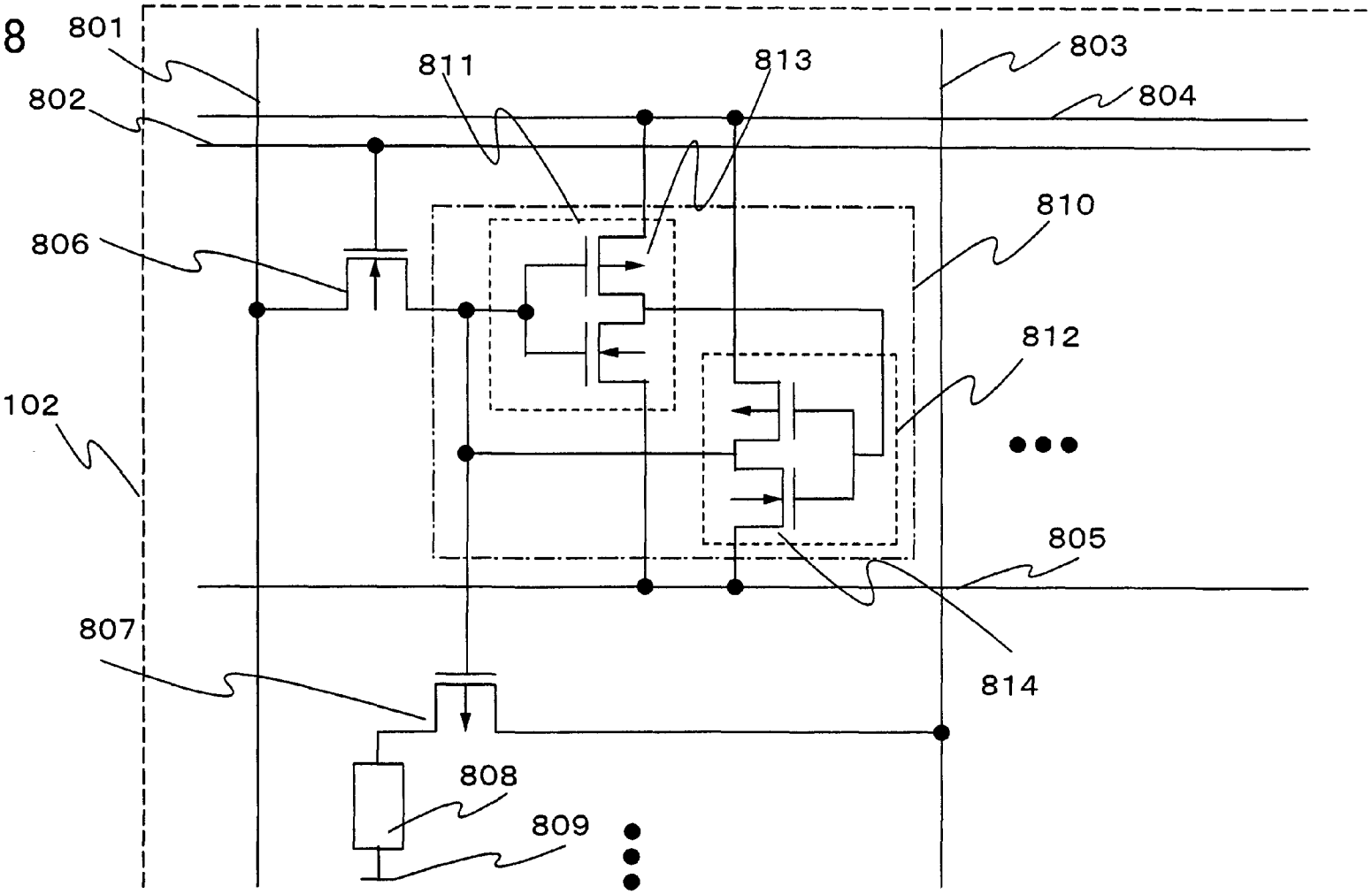
FIG. 8 is a view showing a structural example of an SRAM circuit of Embodiment Mode 8.

FIG. 8 shows a structural example of a display portion of a display device of the present invention.

A display portion 102 is provided with a signal line 801, a scanning line 802, a power supply line 803, an SRAM power supply line 804, a GND line 805, a selecting TFT 806, a driving TFT 807, an EL element 808, and a counter electrode 809. A plurality of pixels, each of which is provided with the EL element 808 and a pixel circuit electrically connected to the EL element 808, is provided in matrix in the display portion 102. The pixel circuit is provided with an SRAM circuit 810, and in the circuit, a first inverter 811 including a first TFT 813 and a second inverter 812 including a second TFT 814 are provided.

A gate electrode of the selecting TFT 806 is connected to the scanning line 802. One electrode of the selecting TFT 806 is connected to the signal line 801, and the other electrode thereof is connected to a gate electrode of the driving TFT 807, a gate electrode of the first inverter 811, and a shared electrode of the second inverter 812. One unshared electrode of the first inverter 811 and one unshared electrode of the second inverter 812 are connected to the SRAM power supply line 804, and the other unshared electrode of the first inverter 811 and the other unshared electrode of the second inverter 812 are connected to the GND line 805.

One electrode of the driving TFT 807 is connected to the power supply line 803, and the other electrode thereof is connected to the counter electrode 809 with the EL element 808 interposed therebetween.

Figure 9:
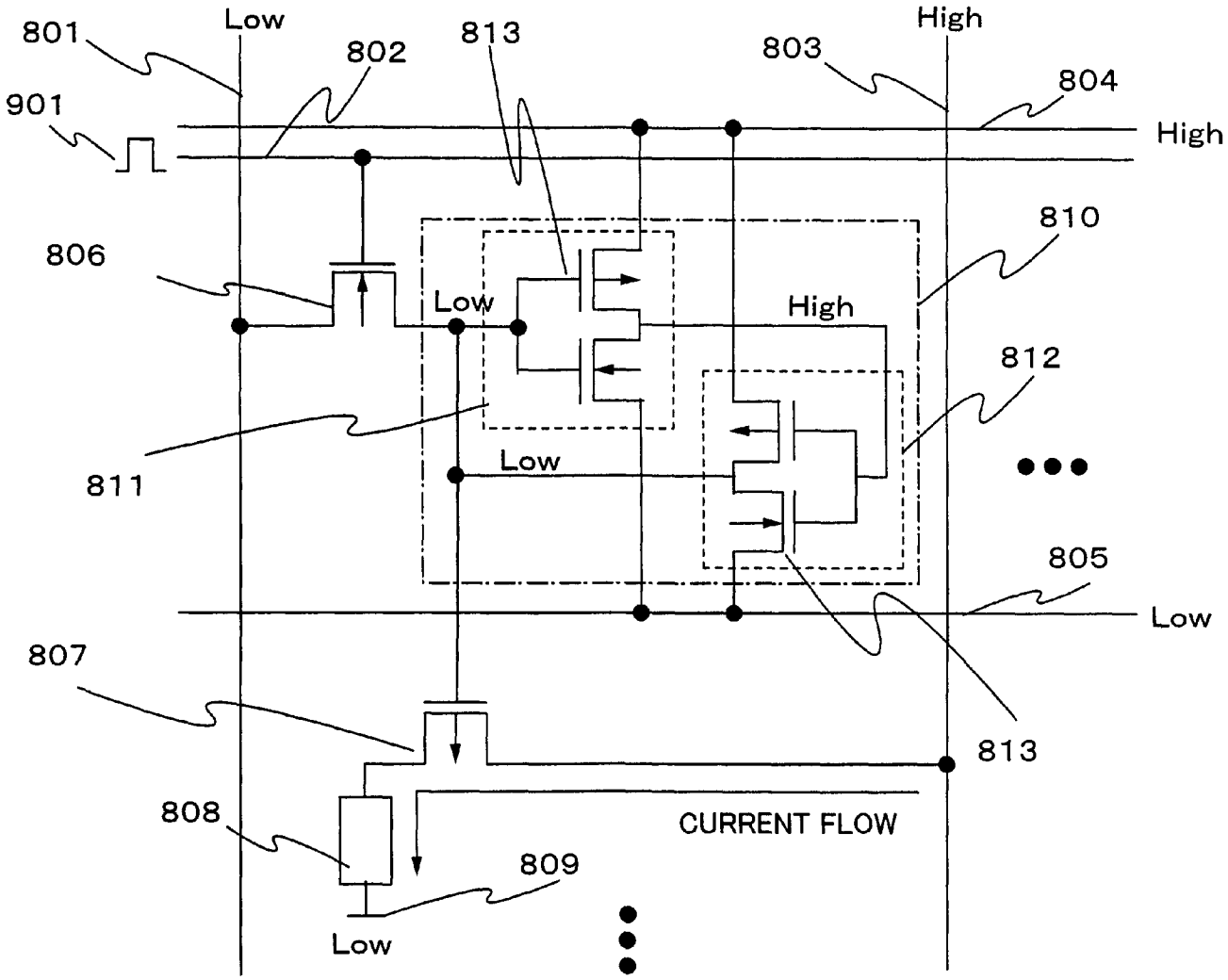
FIG. 9 is a view showing a structural example of an SRAM circuit of Embodiment Mode 8.

FIG. 9 illustrates a specific example in which the SRAM circuit 810 stores an image signal. In the drawing, "High" indicates a positive potential (here, 5V), "Low" indicates a negative potential (here, 0V), and a pulse signal 901 has a pulse of 0V/5V. However, it is needless to say that driving at a given potential is possible, and a potential is not limited to the potential shown in the drawing.

"High" is input to the power supply line 803 and the SRAM power supply line 804, and "Low" is input to the signal line 801, the GND line 805, and the counter electrode 809. In the case where the pulse signal 901 is input to the scanning line 802, the selecting TFT 806 is turned on, and "Low" is input to the SRAM circuit 810. The SRAM circuit 810 is provided with the first inverter 811 including the first TFT 813 and the second inverter 812 including the second TFT 814. Accordingly, the gate electrode of the first inverter 811 outputs "High" obtained by inverting "Low" input to the gate electrode of the first inverter 811, and "High" is input to a gate electrode of the second inverter 812. Further, the gate electrode of the second inverter 812 outputs "Low" obtained by inverting "High" input to the gate electrode of the second inverter 812, and "Low" is input to both the gate electrode of the first inverter 811 and the gate electrode of the driving TFT 807.

When "Low" is input to the gate electrode of the driving TFT 807, the driving TFT 807 is turned on. Since the power supply line 803 is connected to the counter electrode 809 with the EL element 808 interposed therebetween, a potential difference is generated between the power supply line 803 ("High") and the counter electrode 809 ("Low"). Therefore, current flows from the power supply line 803 toward the counter electrode 809, whereby the EL element 808 emits light.

Next, a state is described where the pulse signal 901 has passed (which means that "Low" is input to the scanning line 802). In a potential state shown in FIG. 9, when "Low" is input to the gate electrode of the selecting TFT 806, the selecting TFT 806 is turned off. "Low" of the signal line 801 which had been input through the selecting TFT 806 is not input to the gate electrode of the driving TFT 807 and the gate electrode of the first inverter 811 in the SRAM circuit 810. However, since the first inverter 811 and the second inverter 812 in the SRAM circuit 810 repeat input and output mutually, "Low", which is output from the second inverter 812, is input to the gate electrode of the driving TFT 807 and the gate electrode of the first inverter 811 in the SRAM circuit 810.

When "Low" is input to the gate electrode of the driving TFT 807, as described above, current flows from the power supply line 803 toward the counter electrode 809, whereby the EL element 808 emits light.

In this manner, even if the selecting TFT 806 is turned off, an image signal which is once input from the signal line 801 is stored until the selecting TFT 806 is turned on and another image signal is input or until a power source is shut off so that driving is stopped.

In this embodiment mode, the case is described in which the driving TFT 807 is turned on and the EL element 808 emits light when "Low" is input to the signal line 801. However, the case can be similarly considered in which "High" is input to the signal line 801. In that case, the driving TFT is turned off and the EL element 808 does not emit light.

As described above, an image signal received from a wireless communication device can be stored in the SRAM circuit. Here, one example of the SRAM circuit is described. However, it is needless to say that the SRAM circuit of the present invention is not limited to this.

Note that a display element, a display device which is a device having a display element, a light-emitting element, and a light-emitting device which is a device having a light-emitting element can employ various types and can include various elements.

For example, as a display element, a display device, a light-emitting element, or a light-emitting device, a display medium whose contrast, luminance, reflectivity, transmissivity, or the like changes by an electromagnetic action, such as an EL element (e.g., an organic EL element, an inorganic EL element, or an EL element including both organic and inorganic materials), an electron-emissive element, a liquid crystal element, electronic ink, an electrophoresis element, a grating light valve (GLV), a plasma display panel (PDP), a digital micromirror device (DMD), a piezoelectric ceramic display, or a carbon nanotube can be employed.

Note that display devices using an EL element include an EL display; display devices using an electron-emissive element include a field emission display (FED), an SED-type flat panel display (SED: Surface-conduction Electron-emitter Display), and the like; and display devices using a liquid crystal element include a liquid crystal display (e.g., a transmissive liquid crystal display, a semi-transmissive liquid crystal display, a reflective liquid crystal display, a direct-view liquid crystal display, or a projection liquid crystal display).

(Embodiment 1)

Figure 10:
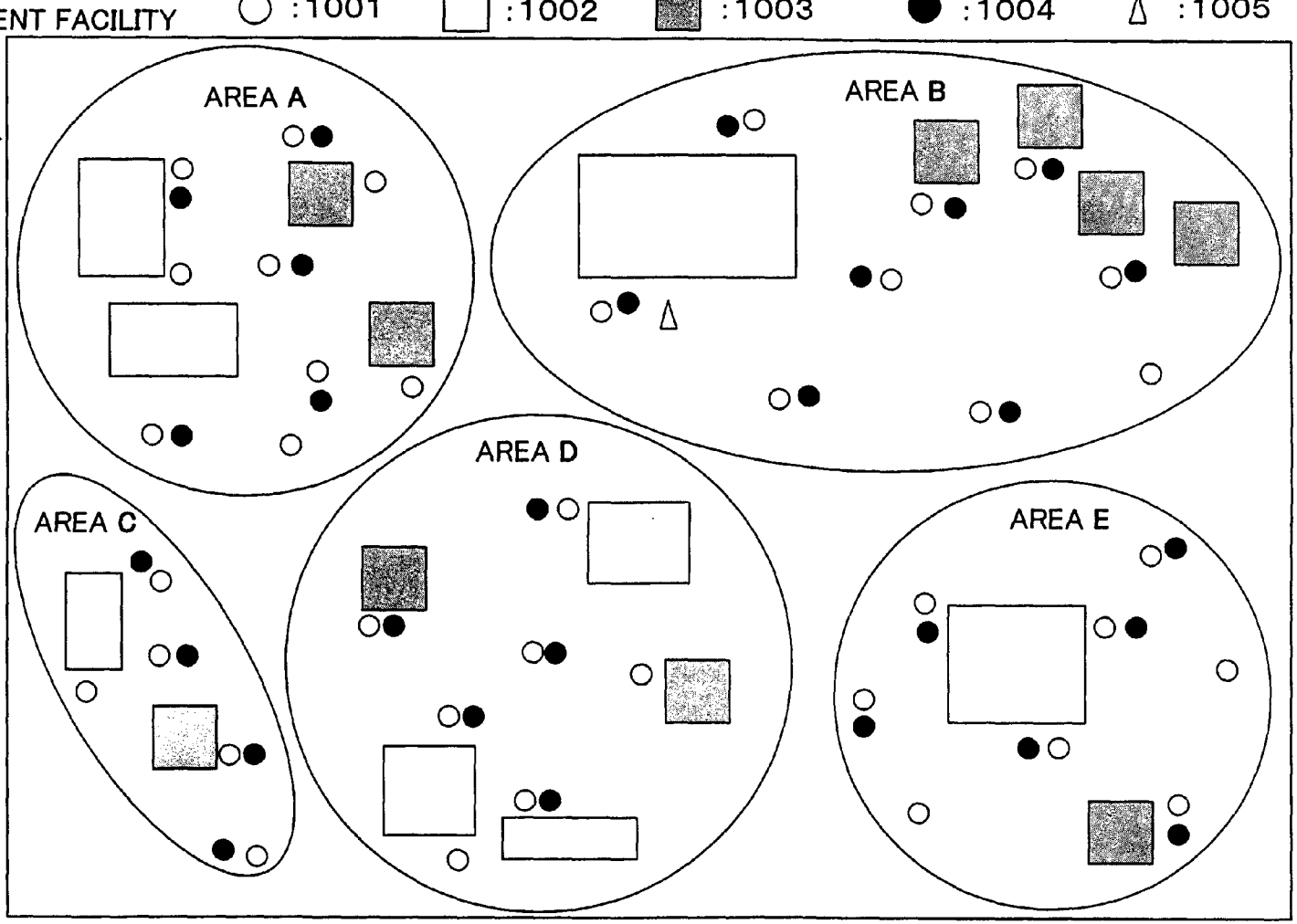
FIG. 10 is a view illustrating an embodiment.

In an amusement facility such as an amusement park or a theme park as shown in FIG. 10, for example, a display device of the present invention is lent at the time of admission as a portable display device, and mainly displays a present position or present time, and further, displays information such as instructions on an attraction or waiting time of an attraction depending on a case.

A plurality of reader/writers 1001 is provided in each area; therefore, a user 1005 can check the present position by a given reader/writer 1001 in the case or the like where the user 1005 want to know the present position, and the user 1005 is not bothered with unfolding a map or the like.

The reader/writer 1001 near an attraction 1002 can display information such as instructions on the attraction, waiting time of the attraction, or the like, and the reader/writer 1001 near a restaurant or shop 1003 can display a menu, information on a product, or the like. Accordingly, the user 1005 can make a plan easily and can make effective use of time.

Since the display device is driven with electric power generated by wireless communication, a plurality of people can receive wireless communication at the same time with the use of one reader/writer. Further, the display device is convenient because the trouble that accompanies connection of a code as the case of wired charging can be omitted.

Since information acquired by the user 1005 can be held for a certain period of time, the user 1005 can leave from the reader/writer 1001. Therefore, congestion due to waiting for acquisition of information does not occur.

Further, a plurality of storage boxes 1004 is provided in each area. In the case where the display device is no longer needed, the display device may be left in the given storage box 1004, and in the case where the display device is needed, the display device may be taken out from the given storage box 1004.

The storage box 1004 is provided with the reader/writer 1001 for transmitting an electric wave or an electromagnetic wave which can charge a wireless charge circuit, whereby the wireless charge circuit provided in the display device in the storage box 1004 can be charged.

Further, the display device which is lent can be taken home. In that case, it is necessary to buy the display device; however, the display device can be used at the time of coming to the facility again or going to another amusement facility or the like employing a similar system.

This application is based on Japanese Patent Application serial No. 2006-353029 filed with Japan Patent Office on Dec. 27, 2006, the entire contents of which are hereby incorporated by reference.

What is claimed is:

1. A display device comprising:

a display portion;

a pixel circuit in the display portion, the pixel circuit including an SRAM circuit;

a first circuit configured to control the pixel circuit;

a first antenna circuit configured to receive a first electromagnetic wave with a first wavelength;

a second antenna circuit configured to receive a second electromagnetic wave different from the first electromagnetic wave;

a second circuit configured to generate a first demodulation signal from the first electromagnetic wave received by the first antenna circuit;

a third circuit configured to rectify the first electromagnetic wave received by the first antenna circuit;

a fourth circuit configured to rectify the second electromagnetic wave received by the second antenna circuit;

a fifth circuit configured to generate a first voltage from an output of the third circuit;

a sixth circuit configured to generate a second demodulation signal from the second electromagnetic wave received by the second antenna circuit;

a charge circuit configured to store a second voltage from an output of the fourth circuit;

a charge control circuit configured to control charging of the second voltage to the charge circuit;

a voltage supply control circuit;

a seventh circuit configured to control the charge control circuit and the voltage supply control circuit; and an eighth circuit configured to select one of the first voltage and the second voltage, wherein the voltage supply control circuit is configured to supply the second voltage to the eighth circuit, and wherein the eighth circuit comprises a storage capacitor and the storage capacitor is configured to compensate voltage supply to the first circuit in a period when voltage is not supplied to the first circuit, which occurs when voltage selected in the eighth circuit is supplied to the first circuit.

2. The display device according to claim 1, wherein the second antenna circuit has a different shape from the first antenna circuit.

3. The display device according to claim 1, wherein the first electromagnetic wave is a wireless signal from a reader/writer and the second electromagnetic wave is randomly generated outside.

4. The display device according to claim 1, wherein the seventh circuit includes a voltage comparison circuit.

5. The display device according to claim 1, wherein the seventh circuit includes a counter circuit.

6. The display device according to claim 1, wherein the first antenna circuit and the second antenna circuit are provided over a substrate.

7. A display device comprising:

a pixel circuit having an SRAM circuit over a substrate;

a first antenna circuit configured to receive a first electromagnetic wave with a first wavelength;

a second antenna circuit configured to receive a second electromagnetic wave different from the first electromagnetic wave;

a control portion over the substrate;

a first rectifier circuit configured to rectify the first electromagnetic wave received by the first antenna circuit;

a constant voltage circuit configured to generate a first voltage from an output of the first rectifier circuit;

a second rectifier circuit configured to rectify the second electromagnetic wave received by the second antenna circuit;

a charge circuit configured to store a second voltage from an output of the second rectifier circuit;

a charge control circuit configured to control charging of the second voltage to the charge circuit; and a voltage selection circuit configured to determine whether the first voltage and the second voltage are supplied, compare levels of the first voltage and the second voltage with each other when the first voltage and the second voltage are supplied, and select the higher of the first voltage and the second voltage as a selected voltage, wherein the voltage selection circuit comprises a storage capacitor and the storage capacitor is configured to compensate voltage supply to the control portion in a period when voltage is not supplied to the control portion, which occurs when the selected voltage is supplied to the control portion.

8. The display device according to claim 7, wherein one of the first voltage and the second voltage selected in the voltage selection circuit is supplied to a signal line control circuit and a scanning line control circuit.

9. The display device according to claim 7, further comprising:

a voltage supply control circuit connected to the charge circuit; and a circuit configured to control the charge control circuit and the voltage supply control circuit.

10. The display device according to claim 7, further comprising a first demodulation circuit and a second demodulation circuit.

11. The display device according to claim 7, wherein the first electromagnetic wave is a wireless signal from a reader/writer and the second electromagnetic wave is randomly generated outside.

12. The display device according to claim 7, wherein the first antenna circuit and the second antenna circuit are provided over the substrate.

13. A display device comprising:

a pixel circuit having an SRAM circuit over a substrate;

a signal line control circuit and a scanning line control circuit over the substrate;

a first antenna circuit configured to receive a first electromagnetic wave with a first wavelength;

a second antenna circuit configured to receive a second electromagnetic wave different from the first electromagnetic wave;

a signal processing circuit including a first rectifier circuit and a control portion over the substrate, the first rectifier circuit configured to rectify the first electromagnetic wave received by the first antenna circuit; and a power generation portion formed over the substrate, the power generation portion including:

a constant voltage circuit configured to generate a first voltage from an output of the first rectifier circuit;

a second rectifier circuit configured to rectify the second electromagnetic wave received by the second antenna circuit;

a charge circuit configured to store a second voltage from an output of the second rectifier circuit;

a charge control circuit configured to control charging of the second voltage to the charge circuit; and a voltage selection circuit configured to determine whether the first voltage and the second voltage are supplied, compare levels of the first voltage and the second voltage with each other when the first voltage and the second voltage are supplied, and select the higher of the first voltage and the second voltage as a selected voltage wherein the voltage selection circuit comprises a storage capacitor and the storage capacitor is configured to compensate voltage supply to the control portion in a period when voltage is not supplied to the control portion which occurs when the selected voltage is supplied to the control portion.

14. The display device according to claim 13, wherein one of the first voltage and the second voltage selected in the voltage selection circuit is supplied to the signal line control circuit, and the scanning line control circuit.

15. The display device according to claim 13, wherein the power generation portion further comprises:

a voltage supply control circuit connected to the charge circuit; and a circuit configured to control the charge control circuit and the voltage supply control circuit.

16. The display device according to claim 13, wherein the signal processing circuit further comprises a first demodulation circuit, and wherein the power generation portion further comprises a second demodulation circuit.

17. The display device according to claim 13, wherein the first electromagnetic wave is a wireless signal from a reader/writer and the second electromagnetic wave is randomly generated outside.

18. The display device according to claim 13, wherein the first antenna circuit and the second antenna circuit are provided over the substrate.

* * * * *